US006214781B1

(12) United States Patent
Gambogi et al.

(10) Patent No.: US 6,214,781 B1
(45) Date of Patent: Apr. 10, 2001

(54) LIGHT DUTY LIQUID CLEANING COMPOSITIONS COMPRISING AN ORGANOSILANE

(75) Inventors: Joan Gambogi, Belle Mead, NJ (US); Chantal Dalimier, Liege (BE); Marc Paye, Hognoul (BE); Germaine Zocchi, Villers aux Tours (BE)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 09/689,261

(22) Filed: Oct. 12, 2000

(51) Int. Cl.[7] ..... C11D 17/00

(52) U.S. Cl. ..... 510/218; 510/426; 510/428; 510/432; 510/466; 510/470; 510/503; 510/506

(58) Field of Search ..... 510/221, 218, 510/426, 427, 428, 432, 466, 470, 503, 506

(56) References Cited

U.S. PATENT DOCUMENTS

| | | | | |
|---|---|---|---|---|
| 5,707,955 | * | 1/1998 | Gomes et al. | 510/421 |
| 5,789,370 | * | 8/1998 | Thomas et al. | 510/424 |
| 5,854,195 | * | 12/1998 | Jakubicki et al. | 510/426 |
| 5,856,293 | * | 1/1999 | Gambogi et al. | 510/428 |
| 5,874,394 | * | 2/1999 | Thomas et al. | 510/426 |

* cited by examiner

*Primary Examiner*—Necholus Ogden
(74) *Attorney, Agent, or Firm*—Richard Nanfeldt

(57) ABSTRACT

A light duty liquid detergent with desirable cleansing properties to the human skin comprising a $C_{8-18}$ ethoxylated alkyl ether sulfate anionic surfactant, at least one sulfonate anionic surfactant, an alkyl polyglucoside surfactant, an amine oxide surfactant, an oxyethylene functional organosilane and water.

4 Claims, No Drawings

LIGHT DUTY LIQUID CLEANING COMPOSITIONS COMPRISING AN ORGANOSILANE

FIELD OF INVENTION

This invention relates to a light duty liquid cleaning composition which imparts mildness to the skin and which demonstrates improved sensory attributes for the hands designed in particular for dishware and which is effective in grease and is high foaming.

BACKGROUND OF THE INVENTION

The present invention relates to light duty liquid detergent compositions with high foaming properties, which contains mixtures of anionic surfactants, amine oxide surfactant, alkyl polyglucoside surfactant and an oxyethylene functional organosilane.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

U.S. Pat. Nos. 5,326,557 and 5,435,996 disclose oxyethylene functional organic silanes for use in body care formulations.

SUMMARY OF THE INVENTION

It has now been found that an acid light duty liquid detergent can be formulated with a mixture of anionic surfactants, amine oxide surfactant alkyl polyglucoside surfactant, oxyethylene functional organosilane and which has desirable cleaning properties and mildness to the human skin.

An object of this invention is to provide a light duty liquid detergent composition which comprises a sulfate surfactant, at least one sulfonate anionic surfactant, an amine oxide surfactant, an alkyl polyglucoside surfactant and an oxyethylene functional organosilane, wherein the composition does not contain any alkyl monoalkanolamides, polymeric thickeners, stearyl alcohol, mineral oil, sorbitol, triethanol amine, N-alkyl aldonamide, zwitterionic surfactant, silicas, abrasives, alkali metal carbonates, alkaline earth metal carbonates, alkyl glycine surfactant or a cyclic imidinium surfactant.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

The light duty liquid compositions of the instant invention comprises approximately by weight:

(a) 0.5% to 8%, more preferably 1% to 6% of an alkali metal salt of an anionic sulfonate surfactant;

(b) 6% to 18%, more preferably 8% to 12% of an alkali metal salt of a $C_{8-18}$ ethoxylated alkyl ether sulfate and/or an C8–18 alkyl ether sulfate;

(c) 4% to 15%, more preferably 6% to 12% of an alkaline earth metal salt of an anionic sulfonate surfactant;

(d) 1% to 13%, more preferably 2% to 9% of an amine oxide surfactant;

(e) 5% to 20%, more preferably 8% to 16% of an alkyl polyglucoside surfactant;

(f) 0 to 10% of at least one solubilizing agent;

(g) 0.1% to 6%, more preferably 0.5% to 5% of an oxyethylene functional organosilane which functions as a mildness enhancing agent; and (h) the balance being water.

The instant compositions do not contain an N-alkyl aldonamide, choline chloride or buffering system which is a nitrogenous buffer which is ammonium or alkaline earth carbonate, guanidine derivates, alkoxylalkyl amines, alkyleneamines, $C_3$–$C_7$ alkyl and alkenyl monobasic and dibasic acids such as $C_4$–$C_7$ aliphatic carboxylic diacids which do not contain a hydroxy group, phosphoric acid, amino alkylene phosphonic acid and the composition is pourable and is not a gel and the composition has a complex viscosity at 1 rads-1 of less than 0.4 Pascal seconds.

The anionic sulfonate surfactants which may be used in the instant composition of this invention are water soluble and include the magnesium sodium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates and mixtures thereof. The preferred anionic sulfonate surfactant is a $C_{12-18}$ paraffin sulfonate.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or polysulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants have the structure $$R—(OCHCH_2)_nOSO^-{}_3M^+$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

The amine oxide semi-polar nonionic surfactants used in the instant compositions comprise compounds and mixtures of compounds having the formula

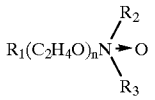

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

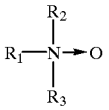

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 which is hereby incorporated herein by reference.

The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6- positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The oxyethylene functional organosilane used in the instant composition is depicted by the formula:

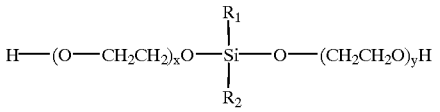

wherein $R_1$ and $R_2$ are a $C_1$ to $C_6$ alkyl group, preferably methyl and x+y equal a number from 2 to 30, preferably 8 to 20. An especially preferred oxyethylene functional organosilane is dimethicone copolyol manufactured by Dow Chemical as DC2501.

The instant light duty liquid nonmicroemulsion compositions contain about 0 to about 10 wt. %, more preferably about 1 wt. % to about 8 wt. %, of at least one solubilizing agent selected from the group consisting of a $C_{2-5}$ mono, dihydroxy or polyhydroxy alkanols such as ethanol, isopropanol, glycerol ethylene glycol, diethylene glycol and propylene glycol and mixtures thereof and alkali metal cumene or xylene sulfonates such as sodium cumene sulfonate and sodium xylene sulfonate. The solubilizing agents are included in order to control low temperature cloud clear properties.

The instant cleaning compositions explicitly exclude alkali metal silicates and alkali metal builders such as alkali metal polyphosphates, alkali metal carbonates and alkali metal phosphonates because these materials, if used in the instant composition, would cause the composition to have a high pH as well as leaving residue on the surface being cleaned.

The final essential ingredient in the inventive cleaning compositions having improved interfacial tension properties is water. The proportion of water in the compositions generally is in the range of 35% to 90%, preferably 50% to 85% by weight of the cleaning composition.

In addition to the above-described essential ingredients required for the formation of the cleaning composition, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

Thus, depending on such factors as the pH of the system and the nature of the primary surfactants, and so on, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $A1^{3+=0}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic surfactant. At higher concentrations of anionic surfactant, the amount of the inorganic magnesium salt will be in range of 0 to 5 wt. %, more preferably 0.5 to 3 wt. %.

The liquid cleaning composition of this invention may, if desired, also contain other components either to provide additional effect or to make the product more attractive to the consumer. The following are mentioned by way of example: Colors or dyes in amounts up to 0.5% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the instant compositions exhibit stability at reduced and increased temperatures. More specifically, such compositions remain clear and stable in the range of 5° C. to 50° C., especially 10° C. to 43° C. Such compositions exhibit a pH of 3 to 9.0. The liquid cleaning compositions are readily pourable and exhibit a viscosity in the range of 300–500 centipoise (cps) as measured at 25° C. with a Brookfield RVT Viscometer using a #21 spindle rotating at 20 RPM.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| | Ref. | A |
|---|---|---|
| Linear alkyl benzene sulfonate sodium salt | 3 | 3 |
| $NH_4C_{13-14}$ AEOS 2:1 EO | 11.6 | 11.6 |
| Linear alkyl benzene sulfonate Mg salt | 9 | 9 |
| Cocoamido propyl dimethyl amine oxide | 6.3 | 6.3 |
| APG 625 | 10.0 | 10.0 |
| Dimethicone copolyol (DC2501) | 0 | 2 |
| Water | Bal. | Bal. |
| pH | 6.8–7.0 | 6.8–7.0 |
| Viscosity (Brookfield viscometer at 25C, spindle 21, 20 RPMS) cps | 450 | 368 |
| LIGHT DUTY LIQUID PERFORMANCE | | |
| Foam volume without soil (ml) | standard | equal |
| Foam volume with soil (ml) | standard | equal |
| Miniplates | standard | equal |
| Tube lard removal (% lard removed) | standard | equal |
| Cup tallow removal (% tallow removed) | standard | equal |
| SENSORY AND CLINICAL PERFORMANCE | | |
| Finger test (scores of the perception of the feel in water) | standard | equal |
| Hand soak wash test (scores of self-perception during hand wash and in after-feel) | standard | -improved foaming rapidity<br>-improved after feel (less dry) |

-continued

| | Ref. | A |
|---|---|---|
| Squamometry (skin surface irritation in vivo) | standard | better |
| Corneosurfametry (skin surface modifications in vitro) | standard | better |

The foam test is an inverted cylinder test in which 100 ml. of a 0.033 wt. % LDL formula in 150 ppm of $H_2O$ is placed in a stoppered graduate cylinder (500 ml) and inverted 40 cycles at a rate of 30 cycles/minute. After 40 inversions, the foam volume which has been generated is measured in mls inside the graduated cylinder. This value includes the 100 ml of LDL solution inside the cylinder. The tube test is a measure of lard removal upon successive dipping in a dilute formulation. The cup test is a measure of beef tallow removal in a static soak situation.

Squamometry (Paye et al. Intl J Cosmet Sci 21: 59–68, 1999) provides a measure of the binding of a cationic dye to the surface of the skin (stratum corneum) previously irritated by surfactants. This is thus an assessment of skin surface irritation by surfactants. The squamometry test was performed on a panel of 6 heathy skin volunteers. Products were applied at 10% v/v in deionized water (total volume of 2.5 ml) on the volar forearm of the volunteers, using half diffusion glass chambers safely secured in place with hypoallergenic tape and elastic bandage. After a period of 30 minutes, solutions and chambers were removed, sites gently rinsed with running tap water and patted dry with paper towel. One hour later, stratum corneum strippings were collected by means of adhesive sticky tape (D-squame®, CuDERM) and stained for 30 seconds with Polychrome Multiple Stain (PMS, Council Bluffs). After rinsing and drying, staining was quantified with the Minolta Chroma Meter® considering the chroma C* value. The more irritated the skin surface, the more the binding of the dye, the higher the value of the chroma C*.

The Corneosurfametry test ( Pierard et al, J Soc Cosmet Chem, 45, 269–277, 1994) predicts in vitro the amount of anionic charges present at the surface of the stratum corneum; these charges mainly come from the binding of anionic surfcatant to stratum corneum (leading to dry after feel) and from protein denaturation (leading to skin irritation). Stratum corneum (collected by the technique of cyanoacrylate skin surface biopsies) from 5 distinct volunteers was incubated into solutions of the test products (3.0% v/v in deionized water, room temperature) for 2 hours. At the end of the incubation, the stratum corneum was rinsed under running tap water and stained for 3 minutes with PMS. After rinsing and drying the staining was quantified with the Chroma Meter® using the L* and C* parameters. The Colorimetric Index of Mildness (CIM) was calculated according to CIM=L*−C*. The higher the CIM, the less the staining. A high CIM value is predictive in the kind the concerned product of a mild product with low binding of anionic surfactant to skin surface.

What is claimed:

1. A clear light duty liquid cleaning composition which comprises by weight:

(a) 0.5% to 8% of an alkali metal salt of an anionic sulfonate surfactant;

(b) 6% to 8% of an alkali metal or ammonium salt of a $C_{8-18}$ ethoxylated alkyl ether sulfate and/or a C8–18 alkyl ether sulfate;

(c) 4% to 15% of an alkalene earth metal salt of an anionic sulfonate surfactant;

(d) 1% to 12% of an amine oxide surfactant;

(e) 5% to 21% of an alkyl polyglucoside surfactant;

(f) 0 to 10% of at least one solubilizing agent;

(g) 0.1% to 6% of a oxyethylene functional organosilane depicted by the formula:

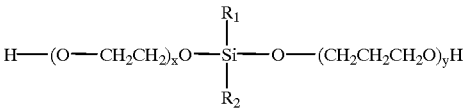

Wherein $R_1$ and $R_2$ are a $C_1$ to $C_6$ alkyl and x and y equal a number from 2 to 30; and (h) the balance being water.

2. The composition of claim 1, wherein said solubilizing agent is selected from the group consisting of sodium, potassium, ammonium salts of cumene, xylene, toluene sulfonates and mixtures thereof.

3. The composition of claim 1, wherein said solubilizing agent is sodium cumene sulfonate.

4. The composition of claim 1, wherein said solubilizing agent is selected from the group consisting of isopropanol, ethanol glycerol, ethylene glycol, diethylene glycol and propylene glycol and mixtures thereof.

* * * * *